US007199694B2

(12) United States Patent
Hao

(10) Patent No.: US 7,199,694 B2
(45) Date of Patent: Apr. 3, 2007

(54) ISOLATED DUAL-CHANNEL TRANSFORMER

(75) Inventor: Kong Hao, Dong Guan (CN)

(73) Assignee: Timothy Su, Taipei (TW)

( * ) Notice: Subject to any disclaimer, the term of this patent is extended or adjusted under 35 U.S.C. 154(b) by 0 days.

(21) Appl. No.: 11/261,768

(22) Filed: Oct. 31, 2005

(65) Prior Publication Data

US 2007/0024406 A1 Feb. 1, 2007

(30) Foreign Application Priority Data

Jul. 26, 2005 (CN) ..... 2005 2 0061789

(51) Int. Cl.
*H01F 27/30* (2006.01)

(52) U.S. Cl. ..... 336/208; 336/198; 336/200

(58) Field of Classification Search ..... 336/208
See application file for complete search history.

(56) References Cited

U.S. PATENT DOCUMENTS 5,861,790 A * 1/1999 Johnson et al. ..... 336/200
6,154,113 A * 11/2000 Murai ..... 336/198
2005/0073385 A1* 4/2005 Wu et al. ..... 336/208

FOREIGN PATENT DOCUMENTS

TW 570268 1/2004

* cited by examiner

*Primary Examiner*—Elvin Enad
*Assistant Examiner*—Joselito S. Baisa
(74) *Attorney, Agent, or Firm*—Rabin & Berdo, P.C.

(57) ABSTRACT

An isolated dual-channel transformer is provided, which comprises: a bobbin with a primary coil-winding portion and two secondary coil-winding portions, for coiling a winding; an insulating cover with a plurality of small slots disposed at the two side edges and a large slot disposed at the central part, for covering the bobbin; and a set of cores integrated with the bobbin via the insulating cover; wherein the insulating cover is used to isolate the set of cores from the winding.

14 Claims, 4 Drawing Sheets

ISOLATED DUAL-CHANNEL TRANSFORMER

CROSS-REFERENCE TO RELATED APPLICATIONS

This non-provisional application claims priority under 35 U.S.C. § 119(a) on Patent Application No(s). 200520061789.8 filed in China, P.R.C. on Jul. 26, 2005, the entire contents of which are hereby incorporated by reference.

BACKGROUND OF THE INVENTION

1. Field of Invention

The present invention relates to a transformer, and more particularly to an isolated dual-channel transformer.

2. Related Art

The transformer serves for transforming the power sources or voltages in an electronic circuitry system so as to meet various demands for different power sources and voltages. A transformer mainly includes a bobbin, cores, pins, and a winding, etc. With the designing trend of being compact, thin, and light, the size of the transformer becomes much smaller, so that the distance between the cores and the winding is made much closer, which may violate the safety requirements. The transformer, constructed by the above components, may be varied in profile, specification, and function. In the traditional transformer design, the bobbin is inserted under the core, so that the thickness of the plastic body of the bobbin must be increased. Accordingly, the overall height of the transformer is too large that the entire thickness of the electronic product will be increased, which will not meet the designing trend of being compact, thin, and light.

In order to meet the designing trend of being compact, thin, and light, the following patents on the transformer structure have emerged. With reference to the Taiwan Patent Publication No. 570268, a transformer structure is disclosed therein for outputting a voltage to the electronic device; wherein several primary windings are connected both in serial and in parallel, and then connected with the core to form a loop. Thus, the transformer can output voltages to multiple electronic devices simultaneously, and its building space is much smaller than that of the conventional construction, wherein multiple transformers are used to output voltages to multiple sets of electronic devices. Thus, the transformer can effectively output voltages to the electronic devices, besides greatly reducing the building space, especially suitable for thin electronic products.

Thus, it has become a hot issue to be solved by researchers to provide a thin transformer with desirable isolation effects and with a thinner structure, to enhance the insulation property and reduce the overall height.

SUMMARY OF THE INVENTION

In view of the above, the main object of the present invention is to provide an isolated dual-channel transformer, wherein the cores and the winding are isolated by the insulating cover to enhance the isolation property of the transformer.

Therefore, to achieve the above object, the isolated dual-channel transformer according to a preferred embodiment of the present invention comprises: a bobbin having at least one primary coil-winding portion and at least two secondary coil-winding portions for coiling a winding, wherein more than one isolation plate is disposed between the primary coil-winding portion and the secondary coil-winding portions, and a wiring plate is extended outwards from each side edge of the secondary coil-winding portions respectively; an insulating cover having a plurality of small slots disposed at the two side edges and a large slot disposed at the central part, for covering the bobbin; and a set of cores integrated with the bobbin via the insulating cover. The insulating cover is used to isolate the set of cores from the winding. When the insulating cover is integrated with the bobbin, the small slots will correspondingly accommodate the external terminals on the wiring plate and the fixed connecting posts on the isolation plate, whereas the large slot will correspondingly accommodate the primary coil-winding portion and the secondary coil-winding portions.

Moreover, to achieve the above object, an isolated dual-channel transformer according to another preferred embodiment of the present invention comprises: a bobbin having at least one primary coil-winding portion and at least two secondary coil-winding portions for coiling a winding, wherein more than one isolation plate is disposed between the primary coil-winding portion and the secondary coil-winding portions, and a wiring plate is extended outwards from each side edge of the secondary coil-winding portions respectively; and a set of cores, made of nickel and zinc (Ni—Zn) and integrated with the bobbin. After the winding is coiled on the external terminals of the wiring plate and on the fixed connecting posts of the isolation plate, an insulation material is coated on the external surfaces of the terminals and the posts to enhance the isolation property and the tensile strength of the terminals.

In such an isolated dual-channel transformer, the cores are isolated from the winding on the bobbin via the concaved insulating cover to enhance the isolation property. The bobbin is constructed to be flat, not only to output multiple voltages simultaneously, but to reduce the overall height of the transformer as well.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1A:
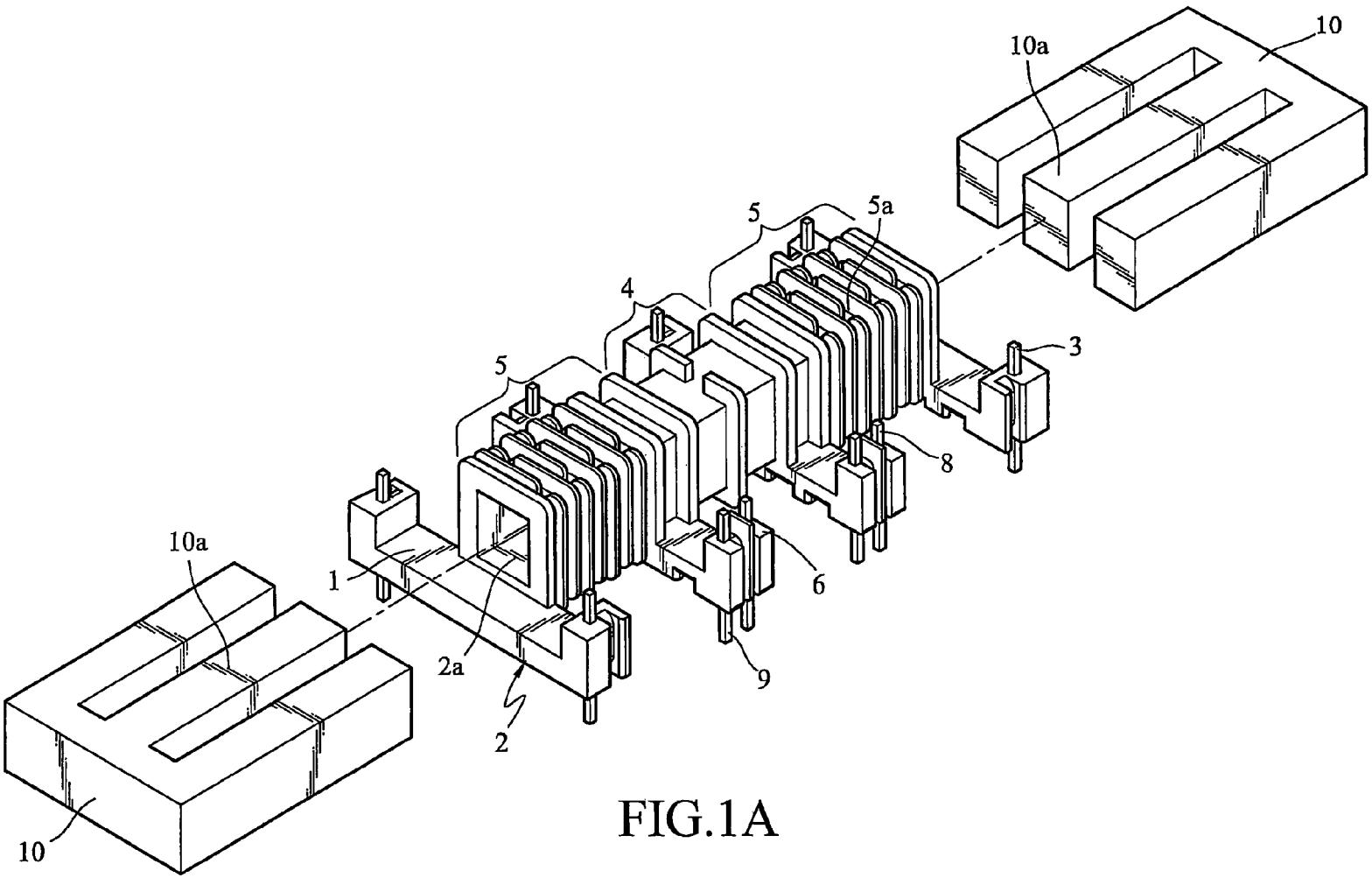
FIG. 1A is a schematic view of the first embodiment of the present invention.
Figure 2:
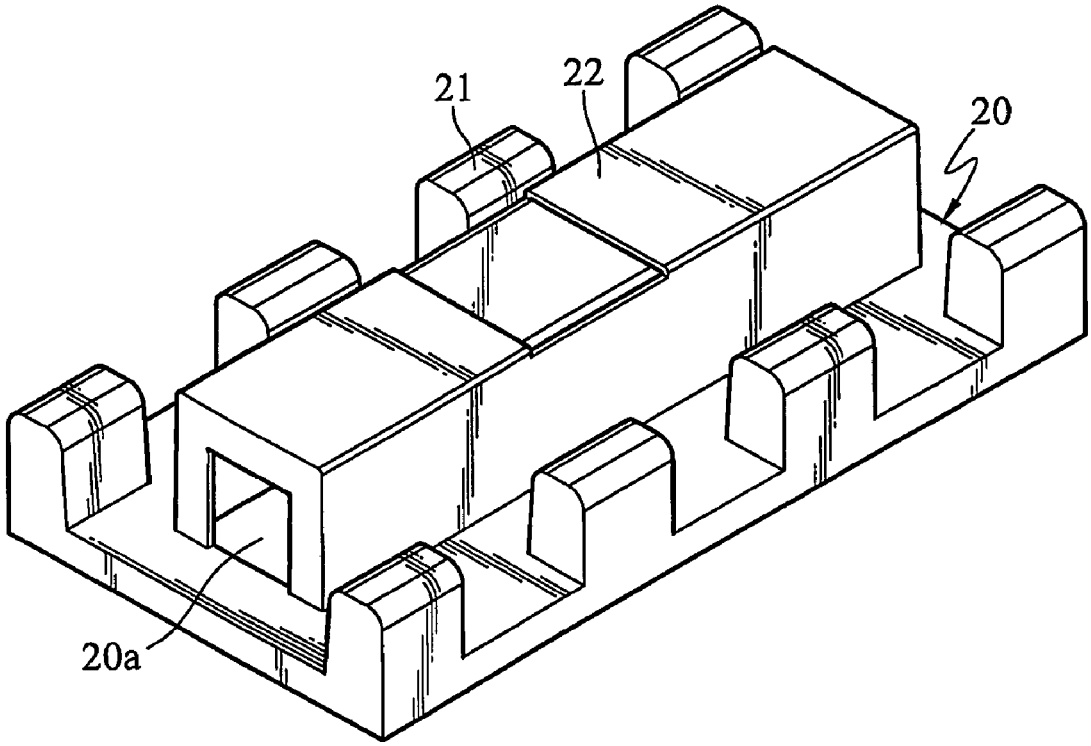
FIG. 2 is a schematic view of an insulating cover of the present invention.

Referring to FIG. 1A, it is a schematic view of the first embodiment of the present invention, which comprises a bobbin 2, E-shaped cores 10, and an insulating cover 20 (as shown in FIG. 2).

The bobbin 2 has a primary coil-winding portion 4 and two secondary coil-winding portions 5, for providing multiple voltages, wherein the primary coil-winding portion 4 is disposed between the two secondary coil-winding portions 5 and forms isolation from the two secondary coil-winding portions 5 respectively via an isolation plate 6. In addition, as shown in the FIGS. 1A and 1B, the secondary coil-winding portions 5 are symmetric each other about the isolation plate 6 as a center for balancing outputting. The fixed connecting posts 8 and pins 9 are provided on the isolation plate 6 for winding and fixing the winding (not shown). A plurality of coil-winding slots 5*a* is disposed on the secondary coil-winding portion 5 for coiling the windings (not shown).

Furthermore, the bobbin 2 has a cavity 2*a* for the E-shaped cores 10 to pass through and to be disposed therein. A wiring plate 1 is extended outwards from the bottom edge of the cavity 2*a* (the two side edges of the secondary coil-winding portions 5) respectively. The wiring plate 1 has both sides constructed into a shape similar to that of the isolation plate 6, with at least one external terminal 3 disposed thereon. The bobbin 2 appears to be a flat structure as a whole, thereby reducing the overall height of the transformer.

The E-shaped core 10 is made of a highly conductive magnetic material, with the middle part 10*a* passing through the cavity 2*a* of the bobbin 2 and being disposed therein.

Figure 1B:
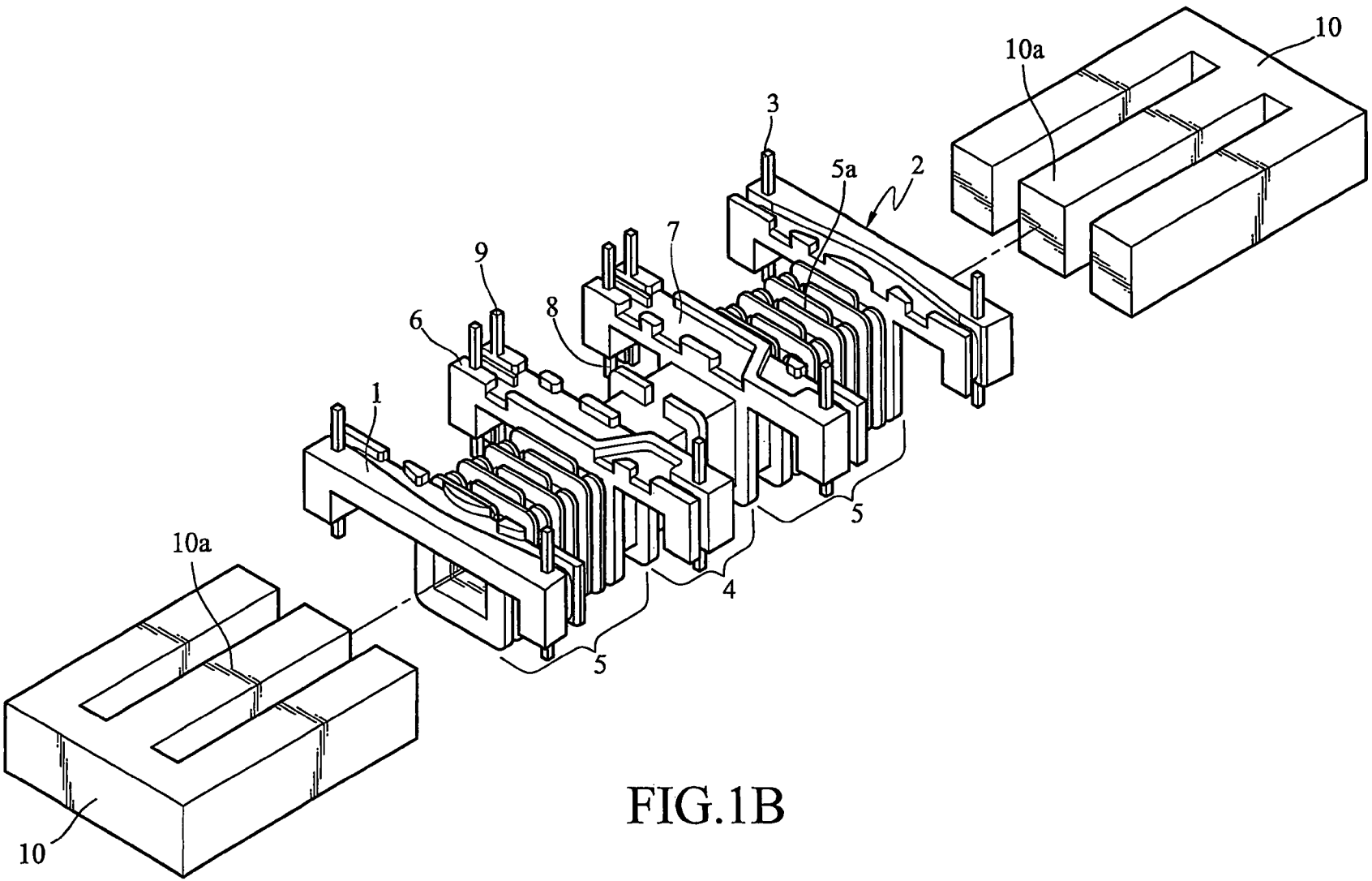
FIG. 1B is a schematic view of the bottom side of the first embodiment of the present invention.

FIG. 1B is a schematic view of the bottom side of the first embodiment of the present invention. Wire channels 7 are provided at the bottom of the isolation plate 6 on the bobbin 2 and the wiring plate 1 to guide the winding passing through and being coiled at a specific location (for example, the primary coil-winding portion 4 or the secondary coil-winding portions 5). Pins 9 are disposed on the bottom side of the isolation plate 6 and external terminals 3 are disposed on the bottom side of the wiring plate 1.

Referring to FIG. 2, it is a schematic view of an insulating cover of the present invention. The insulating cover 20 covers the top half of the bobbin 2 to isolate the core 10 from the winding (not shown), wherein the insulating cover 20 is constructed to be internally concaved and made of an integrated insulating material (for example, plastic). The insulating cover 20 covers the top half of the bobbin 2 to isolate the core 10 from the winding (not shown), having a plurality of small slots 21 disposed at both side edges for accommodating the external raised terminals 3 and the fixed connecting posts 8 on the bobbin 2 correspondingly, and a large raised slot 22 disposed at the central part for accommodating the primary coil-winding portion 4 and the secondary coil-winding portions 5 on the bobbin 2 correspondingly; and a rectangle hole 20*a* is opened on one side of the large slot 22 corresponding to the cavity 2*a* of the bobbin 2.

Figure 3A:
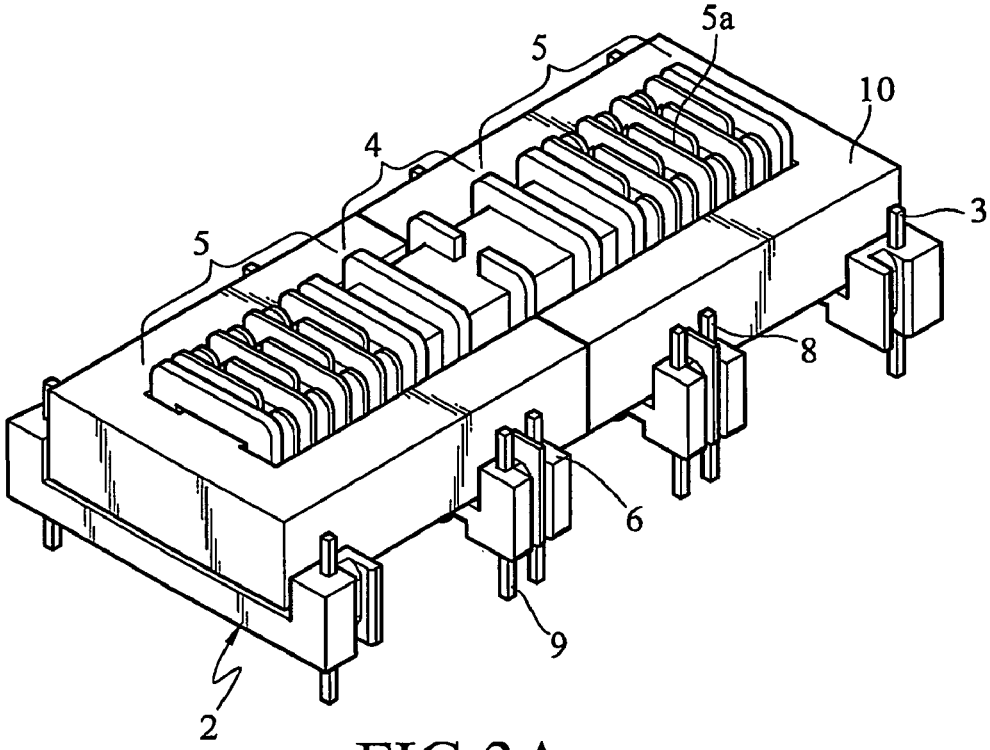
FIG. 3A is a schematic view of a second embodiment of the present invention.
Figure 3B:
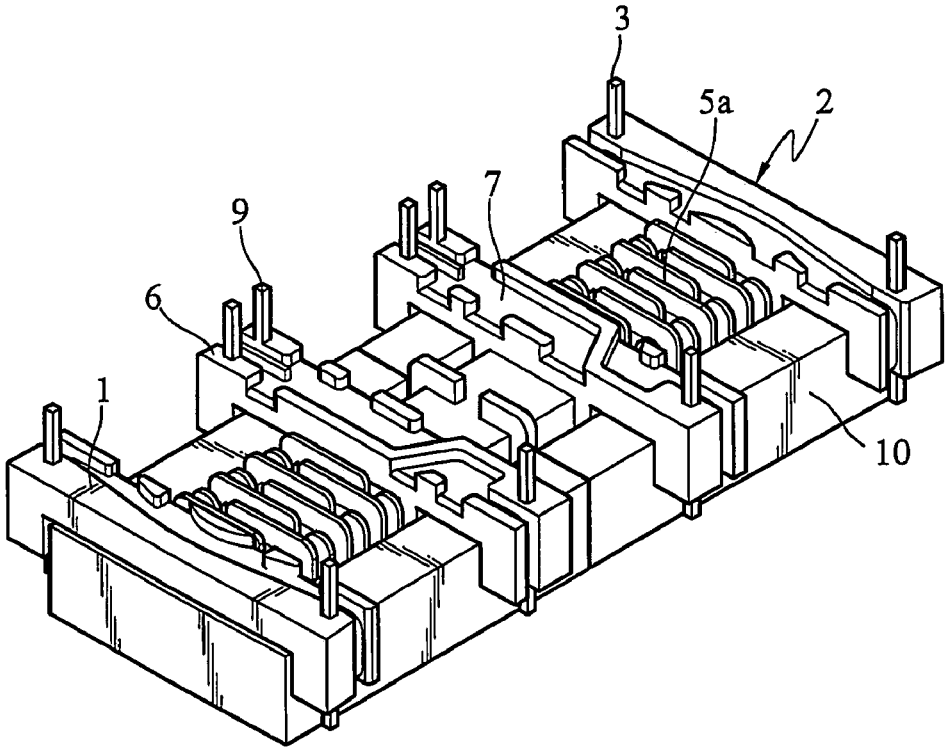
FIG. 3B is a schematic view of the bottom side of the second embodiment of the present invention.

In addition, referring to FIGS. 3A and 3B, FIG. 3A is a schematic view of a second embodiment of the present invention and FIG. 3B is a schematic view of the bottom side of the second embodiment of the present invention. In the second embodiment, the core 10 is made of Ni—Zn or manganese and zinc (Mn—Zn); thereby the insulating cover 20 is unnecessary, which is different from the first embodiment. The structure of the bobbin 2 in the second embodiment is the same as that of the first embodiment, and it will not be described any more. After the winding is coiled on the external terminals 3 and the fixed connecting posts 8, an insulating material (such as epoxy resin, silicon resin) is coated on the external surface of the terminals and the posts, to enhance the isolation property and the tensile strength of the terminals.

In such isolated dual-channel transformer, the cores are isolated from the winding on the bobbin via the concaved insulating cover to enhance the isolation property. Not only multiple voltages are output simultaneously, but the overall height of the transformer is reduced as well.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An isolated dual-channel transformer, comprising:

a bobbin having at least one primary coil-winding portion and at least two secondary coil-winding portions for coiling a winding, the bobbin having more than one isolation plate, each isolation plate being disposed between the primary coil-winding portion and a respective secondary coil-winding portion, the isolation plates having a plurality of fixed connecting posts and a plurality of pins, the bobbin having a wiring plate extended outwards from each side edge of the secondary coil-winding portions respectively, the wiring plate having at least one external terminal, the primary coil-winding portion being disposed between the secondary coil-winding portions, the secondary coil-winding portions being symmetric each other about the isolation plate as a center for balancing outputting;

an insulating cover having a plurality of small slots disposed at the two side edges of the insulating cover and a large slot disposed at a central part of the insulating cover for covering the bobbin; and a set of cores integrated with the bobbin via the insulating cover;

the insulating cover being used to isolate the set of cores from the winding, the insulating cover being so shaped that, in integration with the bobbin, the small slots correspondingly accommodate the external terminal of the wiring plate and the fixed connecting posts of the isolation plates, whereas the large slot correspondingly accommodates the primary coil-winding portion and the secondary coil-winding portions.

2. The isolated dual-channel transformer according to claim 1, wherein the insulating cover is internally concaved.

3. The isolated dual-channel transformer according to claim 1, wherein the bobbin has a cavity for the set of cores to pass through.

4. The isolated dual-channel transformer according to claim 3, wherein the set of cores are a set of E-type cores.

5. The isolated dual-channel transformer according to claim 1, wherein more than one wire channel is provided at the bottom of the isolation plates and at the bottom of the wiring plate.

6. An isolated dual-channel transformer, comprising:

a bobbin having at least one primary coil-winding portion and at least two secondary coil-winding portions for coiling a winding the bobbin having more than one isolation plate, each isolation plate being disposed between the primary coil-winding portion and a respective secondary coil-winding portion, the isolation plates having a plurality of fixed connecting posts and a plurality of pins, the bobbin having a wiring plate extended outwards from each side edge of the secondary coil-winding portions respectively, the wiring plate having at least one external terminal, the primary coil-winding portion being disposed between the secondary coil-winding portions, the secondary coil-winding portions being symmetric each other about the isolation plate as a center for balancing outputting;

a set of cores made of Ni—Zn and integrated with the bobbin; and an insulating material being coated on the external terminal and the fixed connecting posts after the winding is coiled on the external terminal of the wiring plate and on the fixed connecting posts of the isolation plates.

7. The isolated dual-channel transformer according to claim 6, wherein the insulating material is an epoxy resin.

8. The isolated dual-channel transformer according to claim 6, wherein the insulating material is a silicon material.

9. The isolated dual-channel transformer according to claim 6, wherein more than one wire channel is provided at the bottom of the isolation plates and at the bottom of the wiring plate.

10. The isolated dual-channel transformer according to claim 1, wherein the secondary coil-winding portion has a plurality of coil-winding slots for coiling the winding.

11. The isolated dual-channel transformer according to claim 6, wherein the secondary coil-winding portion has a plurality of coil-winding slots for coiling the winding.

12. The isolated dual-channel transformer according to claim 1, wherein the external terminal and the fixed connecting posts are used for winding and fixing the winding.

13. The isolated dual-channel transformer according to claim 6, wherein the external terminal and the fixed connecting posts are used for winding and fixing the winding.

14. An isolated dual-channel transformer, comprising:

a bobbin having one primary coil-winding portion and two secondary coil-winding portions for coiling a winding, the bobbin having two isolation plates, each isolation plate being disposed between the primary coil-winding portion and a respective secondary coil-winding portion, the isolation plates having eight fixed connecting posts and eight pins, the bobbin having a wiring plate extended outwards from each side edge of the secondary coil-winding portions respectively, the wiring plate having two external terminals, the primary coil-winding portion being disposed between the secondary coil-winding portions, the secondary coil-winding portions being symmetric each other about the isolation plate as a center for balancing outputting;

an insulating cover having eight small slots disposed at the two side edges of the insulating cover and one large slot disposed at a central part of the insulating cover for covering the bobbin; and a set of cores integrated with the bobbin via the insulating cover;

the insulating cover being used to isolate the set of cores from the winding, the insulating cover being so shaped that, in integration with the bobbin, the small slots correspondingly accommodate the external terminal of the wiring plate and the fixed connecting posts of the isolation plates, whereas the large slot correspondingly accommodates the primary coil-winding portion and the secondary coil-winding portions, the bobbin having a cavity for the set of cores to pass through, the set of cores being a set of E-type cores, more than one wire channel being provided at the bottom of the isolation plates and at the bottom of the wiring plate.

* * * * *